US006909339B2

(12) United States Patent
Yonekura et al.

(10) Patent No.: US 6,909,339 B2
(45) Date of Patent: Jun. 21, 2005

(54) MOUNTING STRUCTURE OF DIELECTRIC FILTER, DIELECTRIC FILTER DEVICE, MOUNTING STRUCTURE OF DIELECTRIC DUPLEXER, AND COMMUNICATION DEVICE

(75) Inventors: Hiroshi Yonekura, Shiga-ken (JP); Hirofumi Miyamoto, Shiga-ken (JP)

(73) Assignee: Murata Manufacturing Co., Ltd., Kyoto (JP)

( * ) Notice: Subject to any disclaimer, the term of this patent is extended or adjusted under 35 U.S.C. 154(b) by 104 days.

(21) Appl. No.: 10/459,673

(22) Filed: Jun. 12, 2003

(65) Prior Publication Data

US 2003/0231081 A1 Dec. 18, 2003

(30) Foreign Application Priority Data

Jun. 18, 2002 (JP) ..... 2002-177655

(51) Int. Cl.[7] ..... H01P 5/12; H01P 3/06

(52) U.S. Cl. ..... 333/134; 333/206; 333/132; 333/219.1

(58) Field of Search ..... 333/134, 206, 333/126, 129, 132, 202, 219.1

(56) References Cited

U.S. PATENT DOCUMENTS 5,572,175 A * 11/1996 Tada et al. ..... 333/206
5,691,674 A * 11/1997 Yorita et al. ..... 333/202

* cited by examiner

*Primary Examiner*—Daniel Chang
(74) *Attorney, Agent, or Firm*—Dickstein, Shapiro, Morin & Oshinsky, LLP.

(57) ABSTRACT

An excitation hole is provided inside a dielectric block and, on the outer surface of the dielectric block, an input-output terminal electrically connected to an inner conductor inside the excitation hole is formed at one end portion of the excitation hole. A grounding-electrode-free portion is provided on the surface opposite to an input-output electrode of a mounting substrate with which the input-output terminal makes contact. Thus, the electric field strengths in upward and downward directions toward an outer conductor of the dielectric block from the excitation hole are balanced to suppress spurious TE-mode signals, etc.

20 Claims, 8 Drawing Sheets

MOUNTING STRUCTURE OF DIELECTRIC FILTER, DIELECTRIC FILTER DEVICE, MOUNTING STRUCTURE OF DIELECTRIC DUPLEXER, AND COMMUNICATION DEVICE

BACKGROUND OF THE INVENTION

1. Field of the Invention

The present invention relates to a dielectric filter, dielectric filter device, dielectric duplexer, and a communication device having these, which are applied to, for example, high-frequency circuits for mobile communication terminals.

2. Description of the Related Art

The mounting structure of a related dielectric duplexer is shown in FIGS. 8A to 8D. FIG. 8A is a front view of the dielectric duplexer and FIG. 8B is its bottom view. Inside a dielectric block in the form of a substantially rectangular parallelepiped, resonator holes 2*a* to 2*f* and excitation holes 3*a* and 3*b* are provided. On the outer surface of the dielectric block, an outer conductor 4 and input-output terminals 5*a*, 5*b*, and 5*c* are formed. The input-output terminals 5*a* and 5*b* are electrically connected to one end portion of the inner conductor formed on the inner surface of the excitation holes 3*a* and 3*b*, respectively.

FIG. 8C is a top view of a mounting substrate on which the above-mentioned dielectric duplexer is mounted and FIG. 8D is its bottom view. A broken line "A" in FIG. 8C shows an area where the dielectric duplexer is mounted. On the upper surface of the mounting substrate 6, a grounding electrode 7, input-output electrodes 8*a* to 8*c* electrically connected to the input-output terminals of the dielectric duplexer, and lines 9*a* to 9*c* extended from the input-output electrodes 8*a* to 8*c* are formed. A grounding electrode 10 is formed on the whole lower surface of the mounting substrate 6.

In such a dielectric duplexer in which a plurality of resonator holes are provided in a dielectric block, each resonator operates in the TEM mode. However, in the dielectric block in the form of a substantially rectangular parallelepiped on the outer surface of which the outer conductor 4 is formed, the space enclosed by the outer conductor 4 functions as a resonance space for the TE mode and spurious signals (unwanted waves) of the TE mode are generated. This becomes a problem since, in particular, the TE101 mode (mode represented by TExyz when the length and breadth of the mounting surface of the dielectric block are x and y axes and the height is the z axis) becomes close to the frequency band of the TEM mode to be used.

In communication equipment such as portable communication terminals (portable telephones), etc., in designing the devices, a large attenuation value in a frequency band that is two or three times as wide as the transmission frequency band must be secured. For example, in the case of a W-CDMA portable telephone system, since the transmission frequency band on the terminal side is 1920 to 1980 MHz, twice the frequency band (3840 to 3960 MHz) or three times the frequency band (5760 to 5940 MHz) must be secured. In a dielectric filter using the related dielectric block, when a duplexer for the W-CDMA terminal is designed, the peak frequency of the TE101 mode is in the vicinity of 4000 MHz, which is close to twice the transmission frequency band.

Although the peak frequency of the TE101 mode can be changed by the outer dimensions of the dielectric block, when the shift of the peak frequency of the TE101 mode to a fixed frequency is added as a design element, it is not possible to obtain the best characteristics of the TEM mode to be used.

What is described above is valid not only for dielectric duplexers, but also for dielectric filters using dielectric blocks.

SUMMARY OF THE INVENTION

Accordingly, it is an object of the present invention to solve the above-described problem by suppressing spurious signals such as the TE mode, etc., generated in dielectric filters (including dielectric duplexers) using a dielectric block.

According to the present invention, a dielectric filter comprises a dielectric block in the form of a substantially rectangular parallelepiped; resonator holes for resonators and excitation holes for excitation coupled to the resonators, the resonator holes and excitation holes, on the inner surface of which an inductor extending from one surface of the dielectric block to the other surface opposite thereto is formed, the holes being provided inside the dielectric block; input-output terminals electrically connected to the inner conductor of the excitation holes, respectively, and an outer conductor formed on the outer surface of the dielectric block; a mounting substrate on which the dielectric block is mounted; a grounding electrode electrically connected to the outer conductor of the dielectric block and input-output electrodes electrically connected to the input-output terminals provided on the mounting surface of the mounting substrate; a grounding electrode provided on the surface opposite to the mounting surface of the mounting substrate; and grounding-electrode-free portions provided on the mounting substrate at locations opposite to the input-output electrodes.

Because of the above structure, since the electric field strengths or electric lines of force in the upward and downward directions generated between the vicinity of the electrically open-circuited end of the excitation hole (the vicinity of the input-output terminal electrically connected to the inner conductor on the inner surface of the excitation hole) and the outer conductor are balanced, the excitation of the TE mode can be suppressed.

Furthermore, according to the present invention, a dielectric filter comprises a dielectric block in the form of a substantially rectangular parallelepiped; resonator holes for resonators and excitation holes for excitation coupled to the resonators, the resonator holes and excitation holes, on the inner surface of which an inductor extending from one surface of the dielectric block to the other surface opposite thereto is formed, the holes being provided inside the dielectric block; input-output terminals electrically connected to the inner conductor of the excitation holes, respectively, and an outer conductor formed on the outer surface of the dielectric block; a mounting substrate on which the dielectric block is mounted; an adapter substrate disposed between the dielectric block and the mounting substrate; a grounding electrode electrically connected to the outer conductor of the dielectric block and input-output electrodes electrically connected to the input-output terminals, the grounding electrode and input-output electrodes extending from the surface of the adapter substrate with which the dielectric block makes contact to the mounting surface for mounting to the mounting substrate, the grounding electrode and input-output electrodes being provided in the adapter substrate; grounding-electrode-free portions provided at locations, opposite to the input-output electrodes provided on the surface with which the dielectric block makes contact, on the mounting surface of the adapter substrate for mounting to the mounting substrate; and electrodes provided on the mounting substrate in accordance with the grounding electrode and input-output electrodes formed on the mounting surface of the adapter substrate.

Because of the above structure, since the electric field generated between the joint surface, which is between the input-output terminal electrically connected to the inner conductor on the inner surface of the excitation hole and the adapter substrate, and the grounding electrodes, which belong to the adapter substrate and the mounting substrate, is weakened, the electric field strengths in the downward direction (in the direction of the mounting surface) and in the upward direction (in the direction of the surface opposite to the mounting surface) of the excitation hole are balanced and accordingly the excitation of the TE mode can be suppressed.

In a dielectric filter device of the present invention, a dielectric filter having the above structure is joined to an adapter substrate.

Accordingly, when the dielectric filter device having the structure is mounted on a mounting substrate and when the electrode pattern on the mounting surface of the mounting substrate is formed in accordance with the electrode pattern on the mounting surface of the adapter substrate, the adapter substrate is to be disposed between the dielectric filter and the mounting substrate and, as a result, the above described effect can be obtained.

In the same way as in the structure of the dielectric filter, a dielectric duplexer of the present invention comprises a single dielectric block in the form of a substantially rectangular parallelepiped; resonator holes for resonators and excitation holes for excitation coupled to the resonators, the resonator holes and excitation holes, on the inner surface of which an inductor extending from one surface of the dielectric block to the other surface opposite thereto is formed, the holes being provided inside the dielectric block; input-output terminals electrically connected to the inner conductor of the excitation holes, respectively, and an outer conductor formed on the outer surface of the dielectric block; a mounting substrate on which the dielectric block is mounted; a grounding electrode electrically connected to the outer conductor of the dielectric block and input-output electrodes electrically connected to the input-output terminals provided on the mounting surface of the mounting substrate; a grounding electrode provided on the surface opposite to the mounting surface of the mounting substrate; and grounding-electrode-free portions provided on the mounting substrate at locations opposite to the input-output electrodes. In the dielectric duplexer, the input-output terminals constitute an antenna terminal, transmission signal input terminal, or reception signal output terminal, and the resonators constitute a transmission filter portion allowing signals in the transmission frequency band to pass through and a reception filter allowing signals in the reception frequency band to pass through.

Because of this structure, the electric field strengths in the upward and downward directions between the vicinity of the electrically open-circuited end of the excitation hole and the outer conductor are balanced and, as a result, the excitation of the TE mode is suppressed.

In the same way as in the structure of the dielectric filter, a dielectric duplexer of the present invention comprises a single dielectric block in the form of a substantially rectangular parallelepiped; resonator holes for resonators and excitation holes for excitation coupled to the resonators, the resonator holes and excitation holes, on the inner surface of which an inductor extending from one surface of the dielectric block to the other surface opposite thereto is formed, the holes being provided inside the dielectric block; input-output terminals electrically connected to the inner conductor of the excitation holes, respectively, and an outer conductor formed on the outer surface of the dielectric block; a mounting substrate on which the dielectric block is mounted; an adapter substrate disposed between the dielectric block and the mounting substrate; a grounding electrode electrically connected to the outer conductor of the dielectric block and input-output electrodes electrically connected to the input-output terminals, the grounding electrode and input-output electrodes extending from the surface of the adapter substrate with which the dielectric block makes contact to the mounting surface for mounting to the mounting substrate, the grounding electrode and input-output electrodes being provided on the adapter substrate; grounding-electrode-free portions provided at locations, opposite to the input-output electrodes provided on the surface with which the dielectric block makes contact, on the mounting surface of the adapter substrate for mounting to the mounting substrate; and electrodes provided on the mounting substrate in correspondence with the grounding electrode and input-output electrodes formed on the mounting surface of the adapter substrate. In the dielectric duplexer, the input-output terminals constitute an antenna terminal, transmission signal input terminal, or reception signal output terminal, and the resonators constitute a transmission filter portion allowing signals in the transmission frequency band to pass through and a reception filter allowing signals in the reception frequency band to pass through.

Because of the above structure, since the electric field generated between the joint surface of the input-output terminal electrically connected to the inner conductor on the inner surface of the excitation hole and the adapter substrate and the grounding electrode of the adapter substrate and the mounting substrate is weakened, the electric field distribution in the upward and downward directions in the vicinity of the electrically open-circuited end of the excitation hole is balanced and, as a result, the excitation of the TE mode is suppressed.

A communication device of the present invention comprises a dielectric filter or dielectric duplexer of the present invention. With this structure, because of the filtering characteristics in which spurious signals are suppressed, the transmission and cutoff of transmission signals, reception signals, or both in a fixed frequency band can be reliably performed to obtain a communication device having excellent communication characteristics.

DESCRIPTION OF THE PREFERRED EMBODIMENTS

The mounting structure of a dielectric duplexer according to a first embodiment of the present invention is described with reference to FIGS. 1 to 4.

Figure 1:
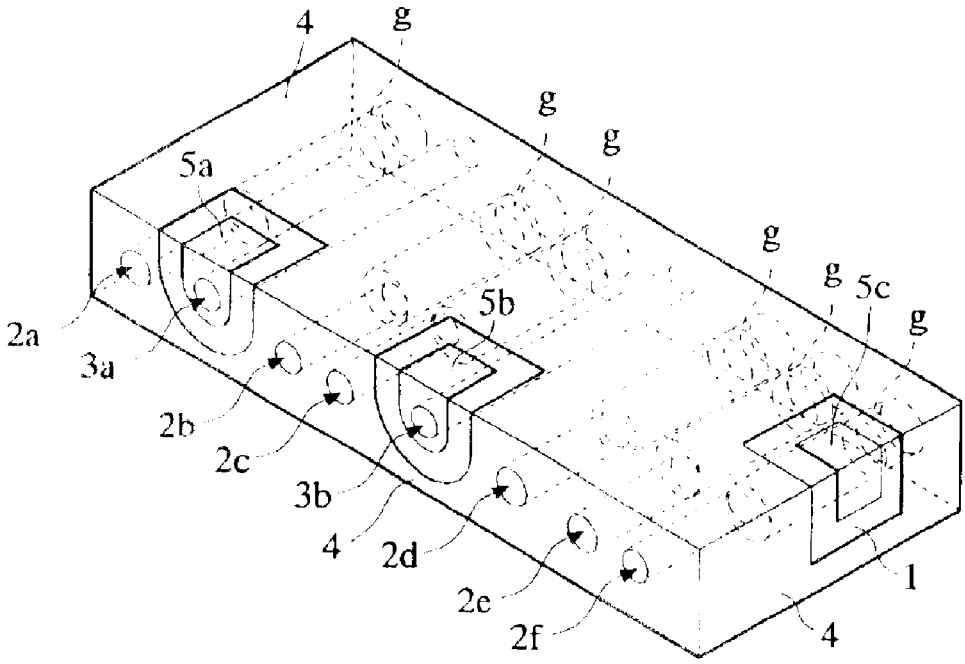
FIG. 1 is a perspective view of a dielectric duplexer according to a first embodiment of the present invention.

FIG. 1 is a perspective view of the dielectric duplexer according to a first embodiment. In FIG. 1, a dielectric block 1 in the form of a substantially rectangular parallelepiped is shown. Inside the dielectric block 1, resonator holes 2*a* to 2*f* and excitation holes 3*a* and 3*b* are provided so as to extend from one surface of the dielectric block 1 to the other surface opposite thereto. On the inner surface of the resonator holes 2*a* to 2*f* and the excitation holes 3*a* and 3*b*, an inner conductor is formed. An outer conductor 4 is formed on the outer surface (six faces) of the dielectric block 1. Furthermore, input-output terminals 5*a* to 5*c*, which are separated from the outer conductor 4, are formed at fixed locations on the outer surface of the dielectric block 1.

While the inner conductor is formed on the inner surface of the resonator holes 2*a* to 2*f*, inner-conductor-free portions g are provided in the vicinity of one end and form electrically open-circuited ends of the resonators. Furthermore, the inner conductors are electrically connected to the outer conductor 4 on the outer surface of the dielectric block 1 at the end portions of the resonator holes opposite to the end portions where the inner-conductor-free portions g are provided and these end portions form electrically short-circuited ends of the resonators. The inner conductors on the inner surface of the excitation holes 3*a* and 3*b* are electrically connected to the input-output terminals 5*a* and 5*b* at one end portion of the inner conductors and are electrically connected to the outer conductor 4 on the outer surface of the dielectric block 1 at the other end portion. Another input-output terminal 5*c* is capacitively coupled to the electrically open-circuited end of the resonator hole 2*f* to produce capacitance.

Each of the resonator holes 2*a* to 2*f* is constructed so as to have a stepped impedance such that the inner diameter at the electrically open-circuited end of the resonator hole is made larger and the inner diameter at the electrically short-circuited end of the resonator hole is made smaller. Resonator hole 2*a* is interdigitally coupled to the excitation hole 3*a*. Since the electrically short-circuited ends of the resonator holes 2*b* and 2*c* are relatively close to each other, the two resonators based on the resonator holes 2*b* and 2*c* are inductively coupled to each other. Since the electrically open-circuited ends of the resonator holes 2*d*, 2*e*, and 2*f* are relatively close to each other, the three resonators based on the resonator holes 2*d*, 2*e*, and 2*f* are capacitively coupled to each other. Furthermore, the excitation hole 3*b* is interdigitally coupled to each of the two resonators based on the resonator holes 2*c* and 2*d*.

When thus constructed, a two-stage resonator made of the resonator holes 2*b* and 2*c* functions as a band-pass filter having an attenuation pole on the high-frequency side and the resonator made of the resonator hole 2*a* functions as a trap resonator in which a fixed frequency is attenuated. Furthermore, a three-stage resonator made of the resonator holes 2*d*, 2*e*, and 2*f* functions as a band-pass filter having an attenuation pole on the low-frequency side.

In this way, the dielectric duplexer is used such that the input-output terminal 5*a* forms a transmission signal input terminal, the input-output terminal 5*b* forms an antenna terminal, the input-output terminal 5*c* forms a reception signal output terminal, a filter made of the resonator provided with the resonator holes 2*a* to 2*c* is used as a transmission filter, and a filter made of the resonator provided with the resonator holes 2*d* to 2*f* is used as a receiving filter.

Figure 2A:
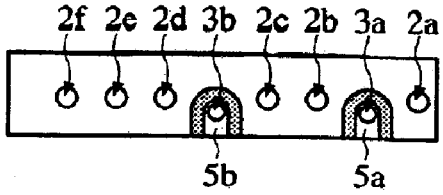
FIGS. 2A to 2D show the structure of the dielectric duplexer shown in FIG. 1 and a mounting substrate for the dielectric duplexer.
Figure 2B:
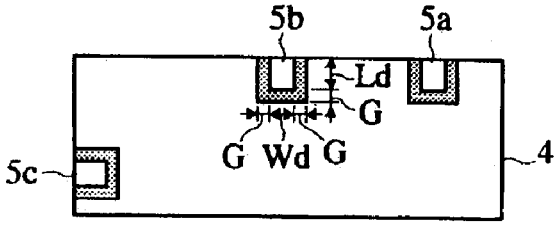
Figure 2C:
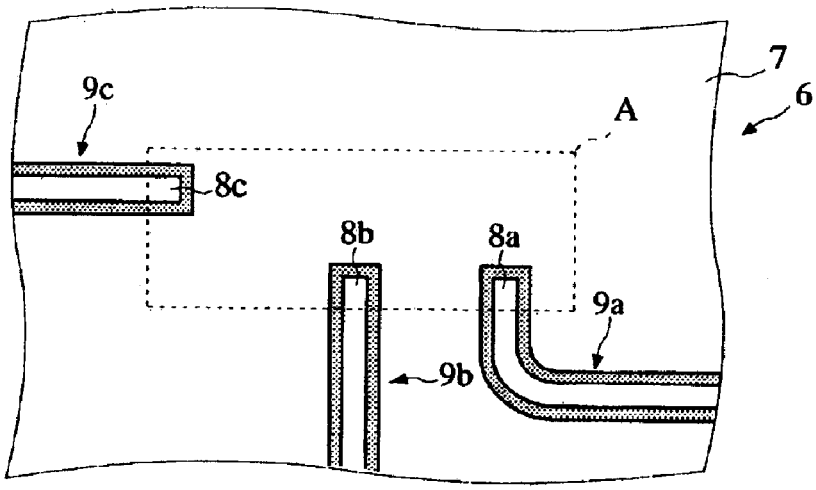
Figure 2D:
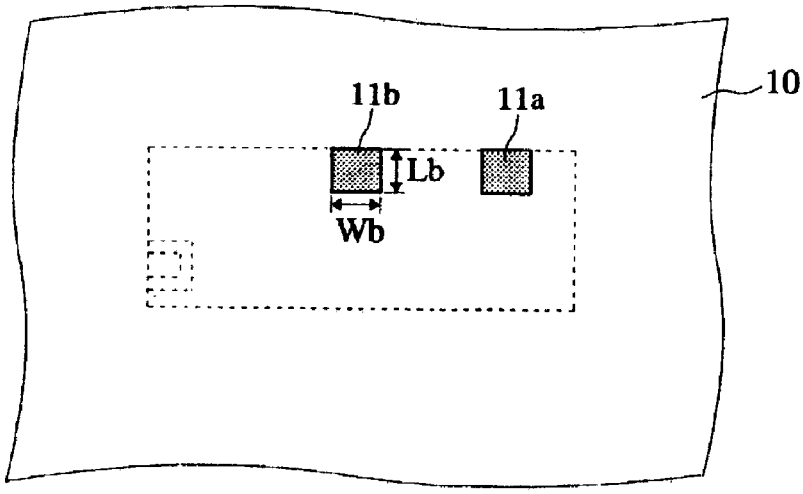

FIGS. 2A to 2D show the dielectric duplexer in FIG. 1 and the structure of a mounting substrate for mounting the dielectric duplexer. FIG. 2A is a front view of the dielectric duplexer in FIG. 1 and FIG. 2B is its bottom view. FIG. 2C is a top view of the mounting substrate for mounting the dielectric duplexer and FIG. 2D is its bottom view. In FIG. 2C, a broken line A shows a mounting area where the dielectric duplexer is mounted. On the top surface of a mounting substrate 6, a grounding electrode 7, input-output electrodes 8*a* to 8*c* electrically connected to the input-output terminals 5*a* to 5*c* of the dielectric duplexer, and lines 9*a* to 9*c* extending from the input-output electrodes 8*a* to 8*c* are formed.

In FIG. 2D, grounding-electrode-free portions 11*a* and 11*b* are shown. The grounding-electrode-free portions 11*a* and 11*b* are provided at locations opposite to the input-output electrodes 8*a* and 8*b* formed on the mounting surface of the mounting substrate 6. In the area excluding the grounding-electrode-free portions 11*a* and 11*b*, a grounding electrode 10 is formed.

Although the size of the grounding-electrode-free portions 11*a* and 11*b* shown in FIG. 2D is dependent on the dimensions of the input-output terminals 5*a* and 5*b* of the dielectric duplexer and the dimensions of the input-output electrodes 8*a* and 8*b* on the side of the mounting substrate, which are designed in accordance with the dimensions of the input-output terminals 5*a* and 5*b* of the dielectric duplexer, and are changed, as an example of the size, in the case of a dielectric duplexer used in a W-CDMA system, the grounding-electrode-free portions 11*a* and 11*b* are in the range of 1.2 mm×0.9 mm to 2.5 mm×2.0 mm. When the dimensions of the mounting surface of the antenna terminal 5*b* shown in FIG. 2B are set to be Wd=1.00 mm, Ld=1.00 mm, and G (outer-conductor-free portion)=0.45 mm, the dimensions of the grounding-electrode-free portion 11*b* are Wb=1.90 mm and Lb=1.45 mm. Furthermore, the dimensions of the grounding-electrode-free portion 11*a* to be connected to the input-output terminal 5*a*, opposite to the input-output terminal 8*a*, are, for example, 2.00 mm×1.50 mm.

Figure 3A:
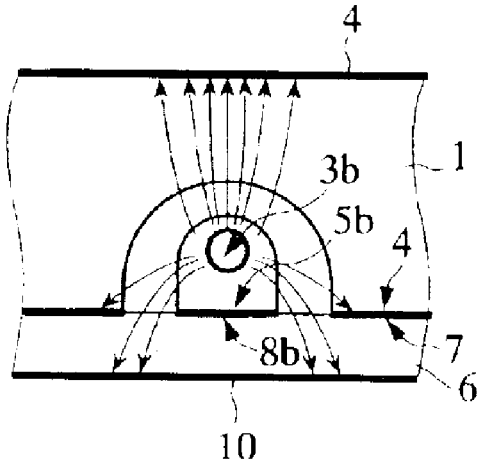
FIG. 3A PRIOR ART
FIG. 3A shows the dielectric field strength around an excitation hole of a related dielectric duplexer.
Figure 3B:
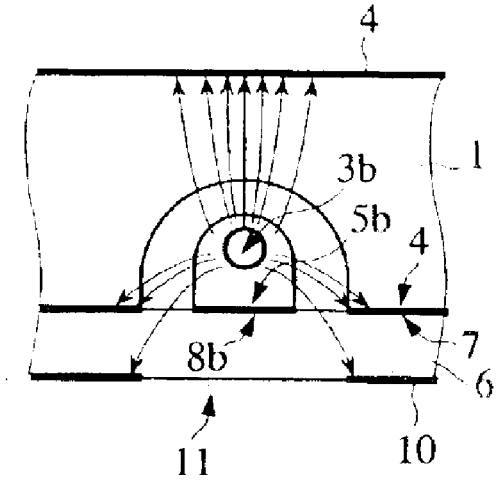
FIGS. 3B and 3C show examples of the electric field strengths around an excitation hole in the dielectric duplexer in FIG. 1.
Figure 3C:
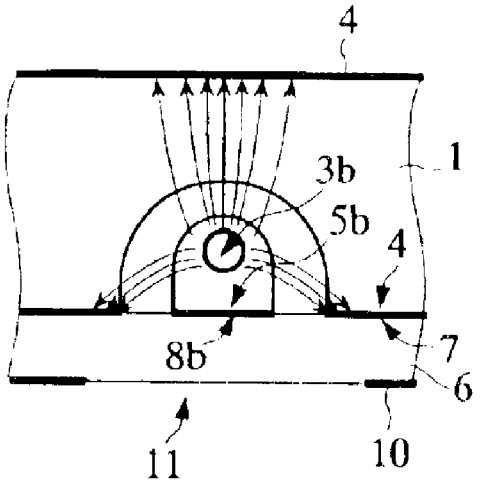

FIGS. 3A to 3C show examples of the electric field distribution around the excitation hole 3*b*. These are partial sectional views in the plane perpendicular to the axis of the excitation hole 3*b* when the dielectric duplexer is mounted on the mounting substrate 6. FIG. 3A shows a related example in which no grounding-electrode-free portion is provided on the mounting substrate 6, and FIGS. 3B and 3C show examples in which a grounding-electrode-free portion 11 is provided on the lower surface, opposite to the mounting surface, of the mounting substrate 6.

As shown in FIG. 3A, an electric field is generated between the excitation hole 3*b* and the grounding electrodes 4 and 10. At that time, part of the electric field of the excitation hole 3*b* is distributed toward the grounding electrode 10 of the mounting substrate 6 through an electrodeless portion between the input-output terminal 5*b* of the dielectric block 1 and the grounding electrode 4 and an electrodeless portion between the input-output electrode 8*b* of the mounting substrate 6 and the grounding electrode 7. Therefore, the electric field strength toward the outer conductor 4 on the mounting surface side of the dielectric block 1 from the excitation hole 3*b* is weakened.

As shown in FIG. 3B, when a grounding-electrode-free portion 11 is provided on the mounting substrate 6, the electric field strength toward the grounding electrode 10 of the mounting substrate 6 from the excitation hole 3*b* is weakened and the electric field strength toward the outer conductor 4 on the mounting surface of the dielectric block 1 from the excitation hole 3*b* is strengthened by the same amount. As a result, when the electric field strength toward the outer electrode 4 on the upper surface side of the dielectric block 1 from the excitation hole 3*b* becomes substantially equal to the electric field strength toward the outer conductor 4 on the mounting surface side, the excitation of the TE mode can be suppressed.

As shown in FIG. 3C, when the grounding-electrode-free portion 11 provided on the mounting substrate 6 is too large, the electric field strength toward the outer electrode 4 on the mounting surface side of the dielectric block 1 from the excitation hole 3*b* becomes stronger than the electric field strength toward the outer conductor 4 on the upper surface side, and spurious signals of the TE mode, etc., are excited.

Therefore, the size and location of the grounding-electrode-free portion 11 can be decided so that the spurious mode may be suppressed to the utmost.

Figure 4A:
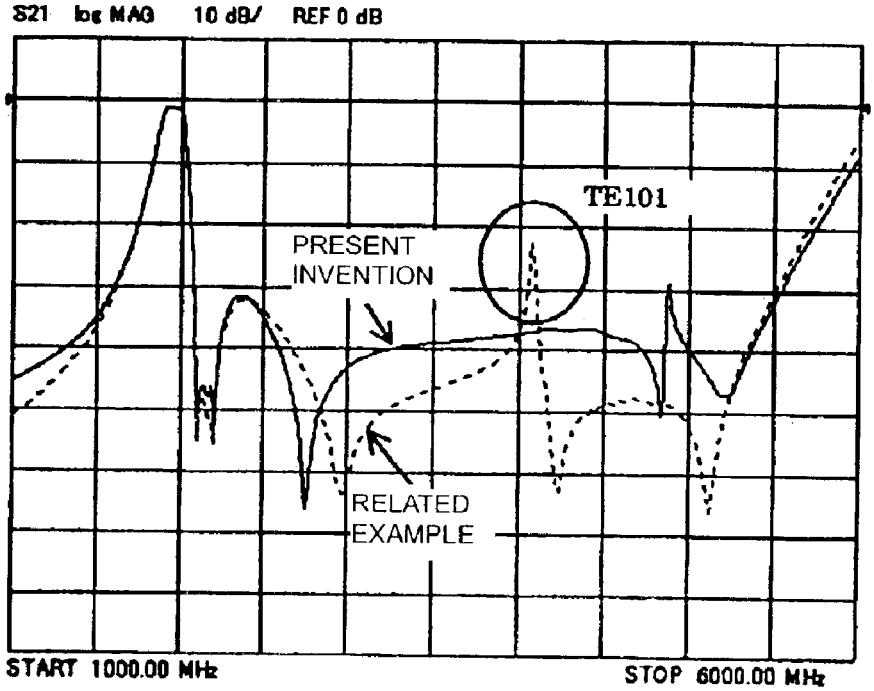
FIGS. 4A and 4B show characteristics of the dielectric duplexer in FIG. 1, compared with a related one.
Figure 4B:
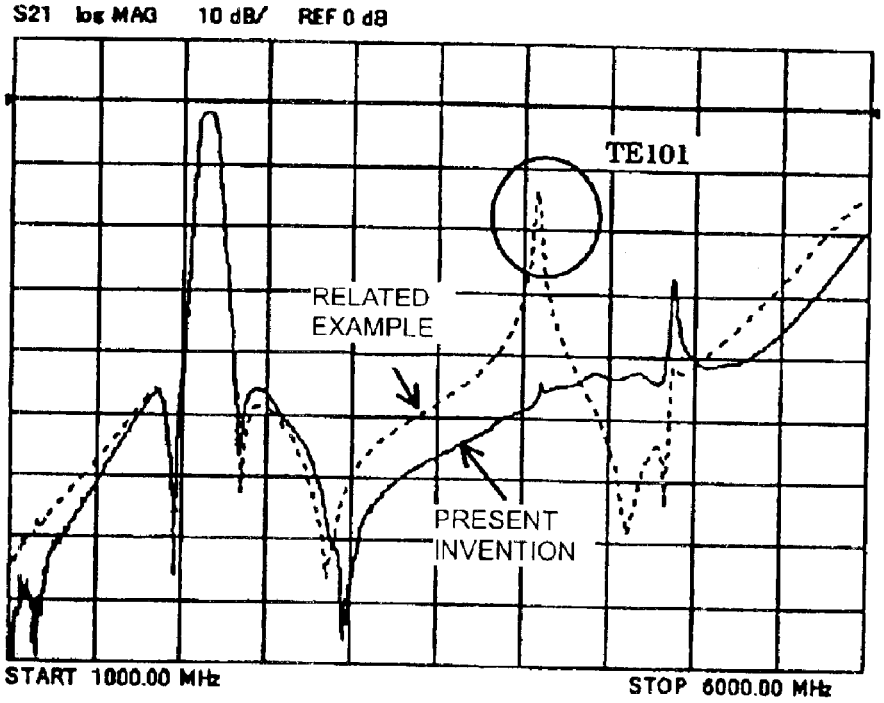

FIGS. 4A and 4B show transmission characteristics of the dielectric duplexer according to the first embodiment. In FIGS. 4A and 4B, the horizontal axis in linear scale represents frequencies from 1 to 6 GHz. The vertical axis represents gain of 10 dB per division and the thick line represents the 0-dB line. FIG. 4A shows transmission characteristics from the transmission signal input terminal to the antenna terminal and FIG. 4B shows transmission characteristics from the antenna terminal to the reception signal output terminal. The broken line in the drawing shows characteristics of a related dielectric duplexer in which no grounding-electrode-free portion 11 is provided, and the solid line shows characteristics of a dielectric duplexer of the present embodiment. The encircled response in the drawings represents the TE101 mode. In this way, because the grounding-electrode-free portion 11 is provided, the TE-mode spurious signal is greatly suppressed. In addition, the characteristics of the passband and the attenuation area neighboring the passband are hardly affected when the grounding-electrode-free portion 11 is provided.

Moreover, in the present embodiment, although the two excitation holes are provided, one or three excitation holes may be provided. Furthermore, although a plurality of excitation holes are provided, a grounding-electrode-free portion may be provided only at a location opposite to an input-output terminal electrically connected to the inner conductor of a principal excitation hole. For example, in the structure shown in FIG. 2, the grounding-electrode-free portion 11*b* may be provided only at the location opposite to the input-output electrode 8*b*.

Next, the structure of a dielectric duplexer device according to a second embodiment of the present invention is described with reference to FIGS. 5A, 5B, and 6.

The dielectric duplexer device contains a dielectric duplexer having the related structure and a new adapter substrate.

Figure 5A:
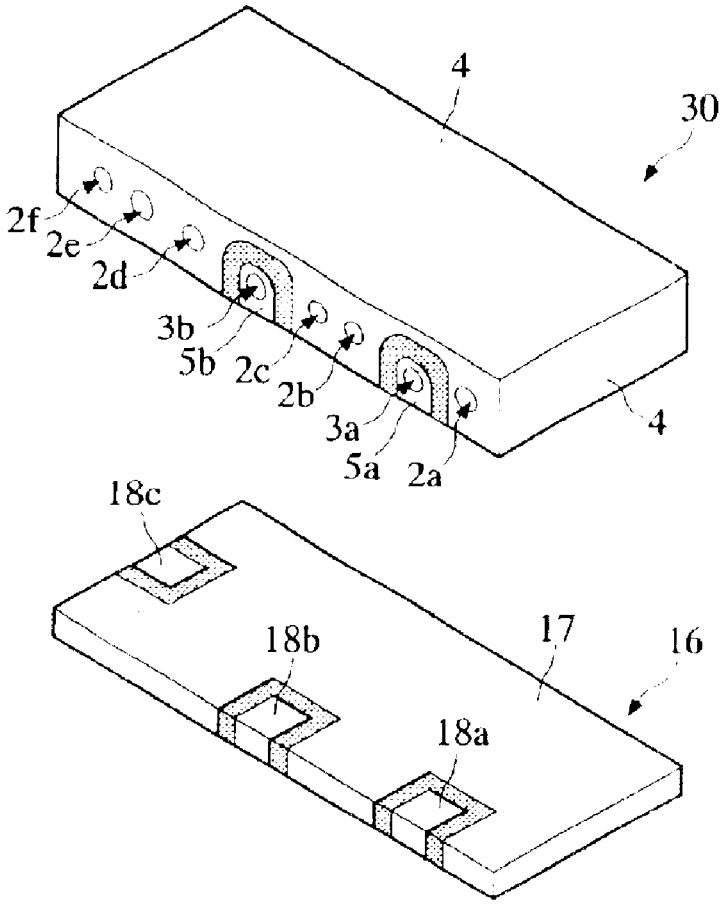
FIGS. 5A and 5B show the mounting structure of a dielectric duplexer according to a second embodiment of the present invention and the structure of a dielectric duplexer device using the dielectric duplexer.
Figure 5B:
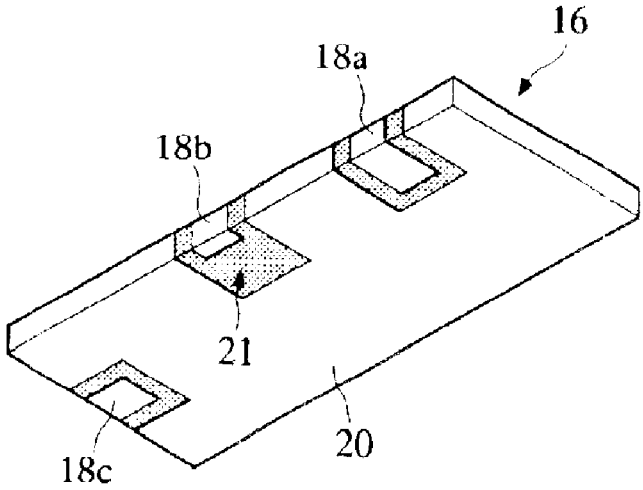

FIG. 5A is an exploded perspective view of the dielectric duplexer device and FIG. 5B is a perspective view as seen from the bottom side, that is, the mounting surface to the mounting substrate, of the adapter substrate. Here, a dielectric duplexer 30 is shown and has the same structure as shown in FIG. 1. That is, the resonator holes 2*a* to 2*f* and excitation holes 3*a* and 3*b* are provided in the dielectric block in the form of a substantially rectangular parallelepiped. The input-output terminals 3*a* and 3*b* and the outer conductor 4 are formed on the outer surface of the dielectric block.

An adapter substrate 16 is shown in the drawings and input-output electrodes 18*a*, 18*b*, and 18*c* are formed from the upper surface through to the lower surface of the insulating substrate. A grounding electrode 17 is formed on the upper surface of the adapter substrate 16 and a grounding electrode 20, which is electrically connected to the grounding electrode 17 on the upper surface, is formed on the lower surface side. A grounding-electrode-free portion 21 is provided in an area on the lower surface opposite to the area in which the input-output electrode 18*b* is formed.

When the dielectric duplexer 30 is joined to the adapter substrate 16, a dielectric duplexer device constituting one part is constructed.

Figure 6:
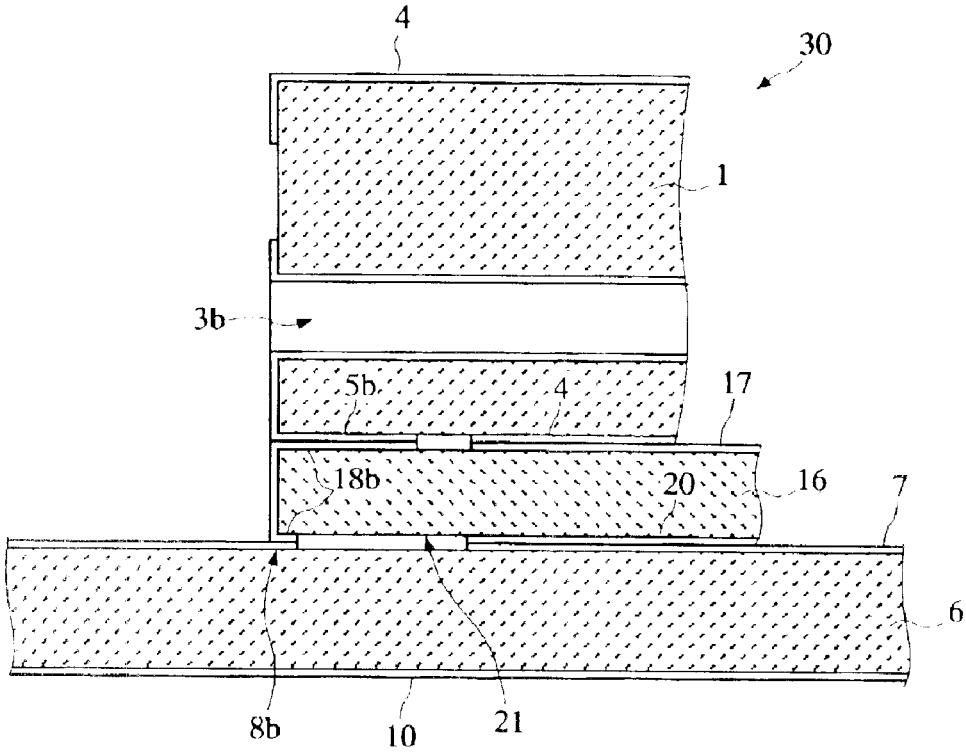
FIG. 6 is a partial sectional view showing the mounting structure of the dielectric duplexer device.

FIG. 6 is a sectional view of the principal portion when the dielectric duplexer device in FIGS. 5A and 5B is mounted on the mounting substrate 6. On the upper surface of the mounting substrate 6, the grounding electrode 7, with which the grounding electrode 20 formed on the lower surface of the adapter substrate 16 makes contact, and the input-output electrode 8*b*, with which the input-output electrode 18*b* of the adapter substrate comes into contact, are formed. The electrodes on the upper surface of the mounting substrate 6 are formed in accordance with the grounding electrode 20 formed on the mounting surface (lower surface) to the substrate 6 of the adapter substrate 16 and the pattern of the input-output electrode 18*b*. Accordingly, no grounding electrode 7 is formed at a location on the mounting substrate 6 corresponding to the grounding-electrode-free portion 21 of the adapter substrate 16.

When thus constructed, in the same way as shown in FIGS. 3A to 3C, the electric field strength toward the outer conductor 4 on the upper surface of the dielectric block 1 from the excitation hole 3*b* and the electric field strength toward the outer conductor 4 on the lower surface of the dielectric block 1 from the excitation hole 3*b* are balanced, and accordingly, the excitation of spurious signals of the TE101 mode, etc., can be suppressed.

Moreover, in the present embodiment, although a dielectric duplexer having two excitation holes is shown, only one excitation hole or three excitation holes may be provided. Furthermore, grounding-electrode-free portions may be provided at locations opposite to the input-output terminals electrically connected to the inner conductor of a plurality of excitation holes, respectively. For example, a grounding-electrode-free portion may be provided at a location opposite to the input-output electrode 18*a* in the structure shown in FIGS. 5A and 5B.

Moreover, in the first and second embodiments, although dielectric duplexers are shown, the invention can be applied to dielectric filters in which a single filter is constructed in a dielectric block.

Next, the structure of a communication device according to a third embodiment of the present invention is described with reference to FIG. 7.

Figure 7:
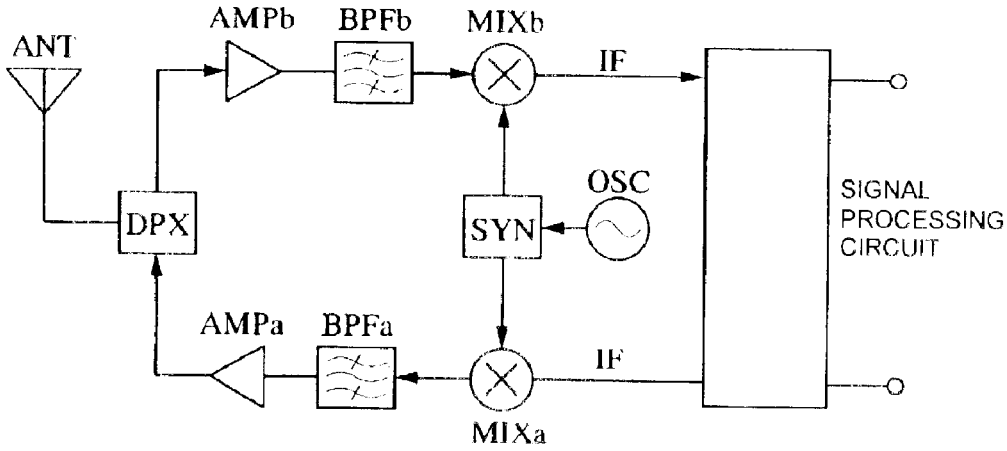
FIG. 7 is a block diagram showing a communication device according to a third embodiment of the present invention.
Figure 8A:
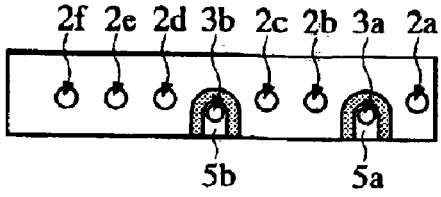
FIG. 8A PRIOR ART
FIGS. 8A to 8D show the structure of a related dielectric duplexer and a mounting substrate for the related dielectric duplexer.
Figure 8B:
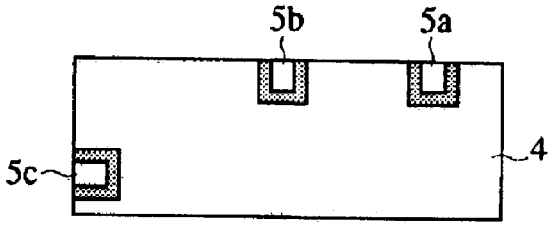
FIG. 8B PRIOR ART
Figure 8C:
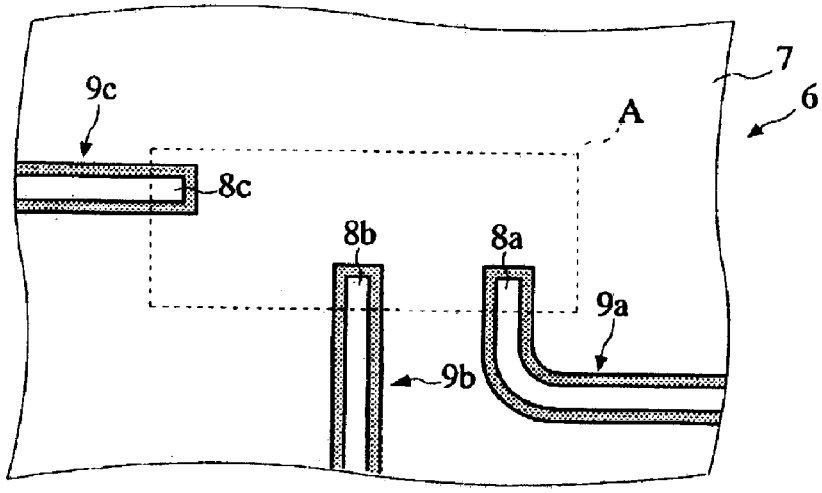
FIG. 8C PRIOR ART
Figure 8D:
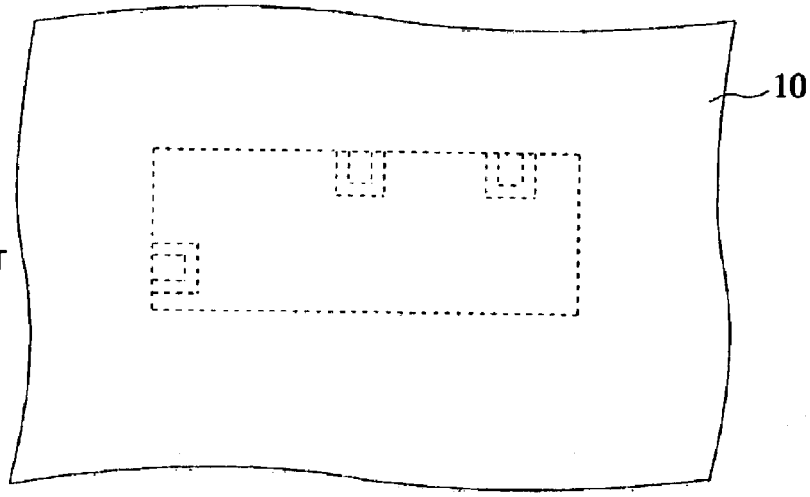
FIG. 8D PRIOR ART

In FIG. 7, a transmission-reception antenna ANT, a duplexer DPX, bandpass filters BPFa and BPFb, amplifiers AMPa and AMPb, mixers MIXa and MIXb, an oscillator OSC, and a frequency synthesizer SYN are shown.

The mixer MIXa mixed a transmission intermediate-frequency signal IF and a signal output from the frequency synthesizer SYN, the bandpass filter BPFa allows only a mixed output signal in the transmission frequency band from the mixer MIXa to pass through, and the amplifier AMPa amplifies the mixed output signal to transmit the signal through the duplexer DPX from the antenna ANT. The amplifier AMPb amplifies a reception signal from the duplexer DPX. The bandpass filter BPFb allows only a reception signal in the reception frequency band output from the amplifier AMPb to pass through. The mixer MIXb mixes a signal output from the frequency synthesizer SYN and a reception signal to output the reception intermediate-frequency signal IF.

A signal processing circuit comprises an audio codec, a TDMA synchronous control circuit, a modulator, a demodulator, a CPU, etc., and a communication device is constructed as a mobile communication terminal (portable telephone) such that a microphone, a loudspeaker, a display, a battery, etc. are connected to the input portion of the signal processing circuit.

In the above bandpass filters BPFa and BPFb, the above-described dielectric filter is used, and, in the duplexer DPX, a dielectric duplexer according to the first or second embodiment of the present invention is used.

In this way, when a dielectric duplexer or dielectric filter having less spurious signals is used, the transmission and cutoff of transmission signals, reception signals, or both in a fixed frequency band can be reliably performed and a communication device having excellent communication characteristics can be obtained.

According to the present invention, the electric field strengths generated in upward and downward directions between the vicinity of an electrically open-circuited end of an excitation hole and an outer conductor are balanced to suppress the excitation of spurious TE-mode signals, etc.

Furthermore, according to the present invention, when a dielectric filter device having the structure in which a dielectric filter and an adapter substrate are joined is mounted on a mounting substrate, the above-described effect can be obtained simply by forming an electrode pattern on the mounting surface of the mounting substrate in accordance with the electrode pattern on the mounting surface of the adapter substrate.

According to the present invention, because of the filtering characteristics in which spurious signals are suppressed, the transmission and cutoff of transmission signals, reception signals, or both in a fixed frequency band can be reliably performed to obtain a communication device having excellent communication characteristics.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A mounting structure comprising:

a dielectric filter having input-output terminals and an outer conductor; and a mounting substrate on which the dielectric filter is mounted, the mounting substrate including:

a first grounding electrode provided on a first surface of the mounting substrate and electrically connected to the outer conductor of the dielectric filter;

input-output electrodes electrically connected to respective input-output terminals of the dielectric filter;

a second grounding electrode provided on a second surface opposite to the first surface of the mounting substrate; and grounding-electrode-free portions provided on the mounting substrate at locations opposite to the input-output electrodes, the grounding-electrode-free portions being sized so as to suppress spurious signals.

2. The mounting structure according to claim 1, wherein the dielectric filter comprises:

a dielectric block;

resonator holes for resonators and excitation holes for excitation coupled to the resonators and being provided inside the dielectric block, the resonator holes and excitation holes having conductors on inner surfaces thereof, the inner conductors extending from one surface of the dielectric block to a surface opposite thereto; and the input-output terminals being electrically connected to a respective conductor of the excitation holes.

3. The mounting structure according to claim 2, wherein the grounding-electrode-free portions arc sized such that an electric field strength toward the second grounding electrode of the mounting substrate from the excitation holes is weakened and an electric field strength toward the outer conductor on the dielectric block from the excitation holes is strengthened.

4. The mounting structure according to claim 3, wherein the grounding-electrode-free portions are sized such that the electric field strength toward the second grounding electrode is weakened and the electric field strength toward the outer conductor is strengthened by the same amount.

5. The mounting structure according to claim 1, wherein the grounding-electrode-free portions are sized such that an excitation of a TE mode can be suppressed.

6. A mounting structure comprising:

a dielectric filter having input-output terminals and an outer conductor; and an adapter substrate on which the dielectric filter is mounted, the adapter substrate including:

a grounding electrode electrically connected to the outer conductor of the dielectric filter and input-output electrodes electrically connected to the input-output terminals of the dielectric filter, the grounding electrode and the input-output electrodes extending from a surface of the adapter substrate with which the dielectric filter makes contact to a mounting surface of the adapter substrate; and grounding-electrode-free portions provided on the mounting surface of the adapter substrate at locations opposite to the input-output electrodes, the grounding-electrode-free portions being sized so as to suppress spurious signals.

7. The mounting structure according to claim 6, wherein the dielectric filter comprises:

a dielectric block;

resonator holes for resonators and excitation holes for excitation coupled to the resonators and being provided inside the dielectric block, the resonator holes and excitation holes having conductors on inner surfaces thereof, the inner conductors extending from one surface of the dielectric block to a surface opposite thereto; and the input-output terminals being electrically connected to a respective conductor of the excitation holes.

8. The mounting structure according to claim 7, further comprising:

a mounting substrate on which the adapter substrate is mounted, the mounting substrate including electrodes provided in accordance with the grounding electrode and input-output electrodes formed on the mounting surface of the adapter substrate.

9. The mounting structure according to claim 6, wherein the grounding-electrode-free portions are sized such that an excitation of a TE mode can be suppressed.

10. A mounting structure comprising:

a dielectric duplexer having input-output terminals and an outer conductor, the dielectric duplexer including:

a dielectric block;

resonator holes for resonators and excitation holes for excitation coupled to the resonators and being provided inside the dielectric block, the resonator holes and excitation holes having conductors on inner surfaces thereof, the inner conductors extending from one surface of the dielectric block to a surface opposite thereto; and the input-output terminals being electrically connected to a respective conductor of the excitation holes; and a mounting substrate on which the dielectric duplexer is mounted, the mounting substrate including:

a first grounding electrode provided on a first surface of the mounting substrate and electrically connected to the Outer conductor of the dielectric filter;

input-output electrodes electrically connected to respective input-output terminals of the dielectric filter;

a second grounding electrode provided on a second surface opposite to the first surface of the mounting substrate; and grounding-electrode-free portions provided on the mounting substrate at locations opposite to the input-output electrodes, wherein the input-output terminals are an antenna terminal, a transmission signal input terminal, and a reception signal output terminal, and at least a first one of the resonator holes form a transmission filter portion allowing signals in the transmission frequency band to pass through and at least a second one of the resonator holes form a reception filter portion allowing signals in the reception frequency band to pass through.

11. The mounting structure according to claim 10, wherein the grounding-electrode-free portions are sized such that an electric field strength toward the second grounding electrode of the mounting substrate from the excitation holes is weakened and an electric field strength toward the outer conductor on the dielectric block from the excitation holes is strengthened.

12. The mounting structure according to claim 11, wherein the grounding-electrode-free portions are sized such that the electric field strength toward the second grounding electrode is weakened and the electric field strength toward the outer conductor is strengthened by the same amount.

13. The mounting structure according to claim 10, wherein the grounding-electrode-free portions are sized such that an excitation of a TE mode can be suppressed.

14. A mounting structure comprising:

a dielectric duplexer having input-output terminals and an outer conductor, the dielectric duplexer including:

a dielectric block;

resonator holes for resonators and excitation holes for excitation coupled to the resonators and being provided inside the dielectric block, the resonator holes and excitation holes having conductors on inner surfaces thereof, the inner conductors extending from one surface of the dielectric block to a surface opposite thereto; and the input-output terminals being electrically connected to a respective conductor of the excitation holes; and an adapter substrate on which the dielectric duplexer is mounted, the adapter substrate including:

a grounding electrode electrically connected to the outer conductor of the dielectric duplexer and input-output electrodes electrically connected to the input-output terminals of the dielectric duplexer, the grounding electrode and the input-output electrodes extending from a surface of the adapter substrate with which the dielectric duplexer makes contact to a mounting surface of the adapter substrate; and grounding-electrode-free portions provided on the mounting surface of the adapter substrate at locations opposite to the input-output electrodes, wherein the input-output terminals are an antenna terminal, a transmission signal input terminal, and a reception signal output terminal, and at least a first one of the resonator holes form a transmission filter portion allowing signals in the transmission frequency band to pass through and at least a second one of the resonator holes form a reception filter portion allowing signals in the reception frequency band to pass through.

15. The mounting structure according to claim 14, further comprising:

a mounting substrate on which the adapter substrate is mounted, the mounting substrate including electrodes provided in accordance with the grounding electrode and input-output electrodes formed on the mounting surface of the adapter substrate.

16. The mounting structure according to claim 14, wherein the grounding-electrode-free portions are sized such that an excitation of a TE mode can be suppressed.

17. A communication device comprising the mounting structure as claimed in claim 1.

18. A communication device comprising the mounting structure as claimed in claim 6.

19. A communication device comprising the mounting structure as claimed in claim 10.

20. A communication device comprising the mounting structure as claimed in claim 14.

* * * * *